United States Patent [19]

Hürtgen

[11] Patent Number: 4,785,985

[45] Date of Patent: Nov. 22, 1988

[54] APPARATUS FOR CONTACTLESS GUIDING OF WEBS OF MATERIAL, IN PARTICULAR, METAL STRIPS, BY MEANS OF A GAS MEDIUM

[75] Inventor: Johann Hürtgen, Nideggen-Schmidt, Fed. Rep. of Germany

[73] Assignee: Otto Junker GmbH, Fed. Rep. of Germany

[21] Appl. No.: 111,101

[22] Filed: Oct. 22, 1987

Related U.S. Application Data

[63] Continuation of Ser. No. 829,775, Feb. 13, 1986, abandoned.

[30] Foreign Application Priority Data

Feb. 15, 1985 [DE] Fed. Rep. of Germany ..... 3505256

[51] Int. Cl.[4] ..... B65H 20/14

[52] U.S. Cl. ..... 226/97; 34/156

[58] Field of Search ..... 34/156; 226/97; 29/421 R

[56] References Cited

U.S. PATENT DOCUMENTS

| | | | |
|---|---|---|---|
| 3,485,429 | 12/1969 | Hutzenlaub | 226/97 |
| 3,823,488 | 7/1974 | Houbon et al. | 226/97 |
| 3,957,187 | 5/1976 | Pulgrodon | 226/97 |
| 3,979,038 | 9/1976 | Karlsson | 226/97 |
| 3,982,327 | 9/1976 | Kurle et al. | 226/97 |
| 3,982,328 | 9/1976 | Gustaffsson et al. | 34/156 |
| 4,069,595 | 1/1978 | Ahlbert et al. | 226/97 |
| 4,292,745 | 10/1981 | Caratsch | 226/97 |
| 4,320,587 | 3/1982 | Vits | 226/97 |

FOREIGN PATENT DOCUMENTS

| | | |
|---|---|---|
| 1193468 | 5/1960 | Fed. Rep. of Germany . |
| 1729222 | 7/1967 | Fed. Rep. of Germany . |
| 2521017 | 11/1976 | Fed. Rep. of Germany . |
| 3318861 | 11/1984 | Fed. Rep. of Germany . |

*Primary Examiner*—P. W. Echols
*Assistant Examiner*—Andrew Rawlins
*Attorney, Agent, or Firm*—Mason, Fenwick & Lawrence

[57] ABSTRACT

In an apparatus for contactless guiding of webs of material, in particular metal strips, by means of a gas medium, nozzle boxes are disposed above and below the web of material. The distances of the nozzle boxes from an imaginary, essentially horizontal center plane extending in the direction of transport differs individually or in groups. The positions of the outlet planes of the nozzle boxes are adaptable to the wave form, and each wave trough and each wave crest of the wave form is formed by at least two adjacent nozzle boxes.

6 Claims, 2 Drawing Sheets

APPARATUS FOR CONTACTLESS GUIDING OF WEBS OF MATERIAL, IN PARTICULAR, METAL STRIPS, BY MEANS OF A GAS MEDIUM

This application is a continuation of application Ser. No. 829,775, filed Feb. 13, 1986, abandoned Oct. 22, 1987.

BACKGROUND OF THE INVENTION

The invention relates to an apparatus for contactless guiding of webs of material, in particular metal strips, by means of a gas medium, with nozzle boxes which are disposed above and below and spaced apart from the web of material and in each case comprise a nozzle outlet plane and between which are provided gas discharge channels above and below the web of material.

Apparatuses of this kind are used in particular for heating or cooling strip-like or web-like material. Air or inert gas which is blown onto the web of material is used predominantly as the gas medium.

There is already known (German Auslegeschrift No. 25 21 017) the possibility of guiding webs of material, in particular metal strips, with a thickness of 0.1 mm or more uniformly and in plane relationship through a gap between oppositely directed nozzle boxes. In this case the nozzle boxes extend at an angle to the direction of transport of the web of material, and the longitudinally or transversely directed nozzles are offset from each other. The nozzle boxes, which are disposed near a web of material, are separated from each other by gas discharge channels for conducting away the gas medium which is blown through the nozzles onto the web of material. In these gas discharge channels are inserted throttle valves for regulating the gas discharge.

With this known apparatus, the guiding of metal strips with a thickness of 0.3 mm or more can no longer be carried out satisfactorily. With strips made of special metal alloys, e.g. some copper alloys, the critical strip thickness may be below 0.3 mm.

Advantageous sinusoidal guiding of metal strips by the apparatus cannot be achieved in this case. The metal strip of appropriate thickness or stiffness leaving the apparatus has, on the contrary, an inadmissibly high proportion of longitudinal folds and other uneven features, so that a high proportion of scrap must be expected.

There is further known an apparatus (German Patent No. 33 18 861) by which webs of material, in particular aluminum strips, can be guided through in floating relationship for the purpose of annealing. In this case nozzle boxes are used which extend at an angle to the direction of transport of the webs of material and which, to form air cushions, each comprise two longitudinal slots or rows of holes whose directions of blowing are inclined towards each other. These nozzle boxes are arranged in pairs above and below the web of material. One of these pairs of nozzle boxes disposed above the web of material is then followed in the direction of transport by another pair of nozzle boxes below the web of material. This pair is then followed in the direction of transport by another pair of nozzle boxes above the web of material. This means that there are large gaps between those pairs of nozzles which are disposed above or below the web of material. Consequently, heating or cooling of the web of material relative to the section of treatment can only be relatively insignificant. To achieve a high plant yield, therefore, a relatively long section of treatment is required with corresponding technical elaborateness.

With the known apparatus, in addition, the carrying capacity of the gas jets inclined towards each other and exiting from the nozzle boxes is very low, so that this apparatus cannot be suitable for relatively thick and heavy metal strips. Although the nozzle boxes have to be constructed at great expense with this apparatus, the sinusoidal path which is the optimum for the supporting and guiding effect cannot be achieved with this known apparatus.

SUMMARY OF THE INVENTION

It is the object of the invention to design an apparatus of the kind mentioned hereinbefore in such a way that with it, both relatively thin and relatively thick and/or stiff strip material, in particular metal strip, can be guided without contact along a sinusoidal path, wherein a high power density is to be achieved for heating or cooling.

This object is achieved according to the invention, in an apparatus of the kind mentioned hereinbefore, by the fact that the nozzle outlet planes of the nozzle boxes disposed above and below the web of material are spaced apart from an essentially horizontal plane corresponding to the direction of transport of the web of material, by distances which vary individually or in groups in the direction of transport.

The distance between the upper and lower nozzle boxes and the web of material can be selected according to the load to be carried. The nozzle boxes may comprise one or more rows of nozzles, wherein slot-type nozzles can be used as well as nozzles with round, oval or otherwise shaped nozzle openings. Air is particularly suitable as the gas medium.

The individual nozzle boxes which are disposed above and below the web of material are placed according to the desired path of the web in the apparatus, which is sinusoidal if possible.

The apparatus according to the invention may further be designed in such a way that the nozzle boxes above and below the web of material are distributed essentially across the same strip width.

The apparatus according to the invention may further be designed in such a way that the nozzle boxes disposed above the web of material are offset from the nozzle boxes disposed below the web of material, in the direction of transport. In this case it is possible for one nozzle box on the upper side of the web of material to be aligned halfway between two nozzle boxes disposed on the lower side of the web of material, and vice versa. Other offset relationships are possible as well.

The apparatus according to the invention may further be designed in such a way that the nozzle boxes disposed above the web of material are offset from the nozzle boxes disposed below the web of material, at an angle to the direction of transport.

The apparatus according to the invention may further be designed in such a way that at least some of the nozzle boxes are vertically adjustable relative to an essentially horizontal plane corresponding to the direction of transport. Due to this capacity for adjustment, the path of the web of material in the apparatus can be changed. In particular, adaptation to varying webs of material and material properties is possible in this case.

Finally, the apparatus according to the invention may be designed in such a way that at least some of the adjustable nozzle boxes are adjustable jointly. In this way, adjustment of the nozzle boxes relative to the web of material can be simplified and thus accelerated.

In the following part of the specification, some embodiments of the apparatus according to the invention are described with reference to drawings.

DESCRIPTION OF THE PREFERRED EMBODIMENTS

Figure 1:
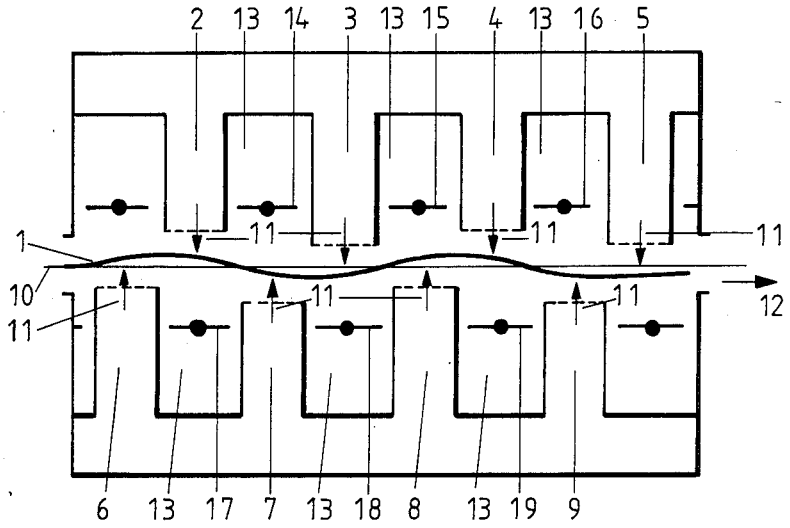
FIG. 1 shows a schematic view of the apparatus according to the invention, with nozzle boxes arranged according to a first embodiment.
Figure 1A:
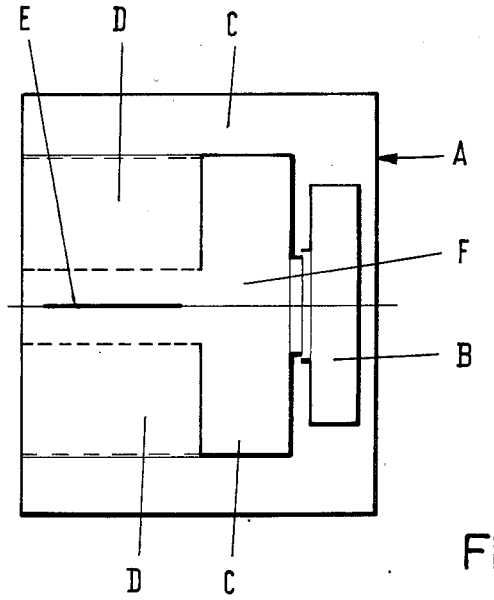
FIG. 1*a* shows a schematic side view of the apparatus according to FIG. 1.

FIG. 1*a* shows schematically an apparatus A in the form of a heating furnace or a cooler. This apparatus A has a fan B which delivers gas streams through pressure channels C to nozzle boxes D. The gas exits from the nozzle boxes D and impinges on a web of material E. From here, the gas is returned to the fan B via a suction channel F. Heating or cooling elements for the gas streams may be provided in the pressure channels C and/or the suction channel F.

A web of material in the form of a metal strip 1 is guided through the apparatus shown in FIG. 1. Above the metal strip 1 are disposed upper nozzle boxes 2 to 5. Below the metal strip 1 are located oppositely directed lower nozzle boxes 6 to 9. An essentially horizontal center plane 10 passes in the direction of transport between the upper nozzle boxes 2 to 5 and the lower nozzle boxes 6 to 9. The nozzle boxes 2 to 9 are arranged different distances away from this center plane 10. Upper nozzle boxes 2 and 4, and lower nozzle boxes 7 and 9, are arranged the same distance away from the center plane 10. Upper nozzle boxes 3 and 5, and lower nozzle boxes 6 and 8, are also the same distance away from the imaginary center plane 10 as each other. The arrows 11 exiting from each nozzle box 2 to 9 in the direction of the metal strip 1 are intended to represent the gas streams exiting from the nozzles of each nozzle box 2 to 9.

The upper nozzle boxes 2 to 5 are offset from the lower nozzle boxes 6 to 9, as seen in the direction of transport of the metal strip 1, which is indicated by an arrow 12.

When gas streams, e.g. air or inert gas, from the nozzle boxes 2 to 9 impinge on the metal strip 1, the metal strip 1 adopts a sinusoidal path.

Between every two adjacent nozzle boxes 2 to 9 is located a gas discharge channel 13. In these gas discharge channels 13 are mounted adjustable throttle valves 14 to 19 by which the quantity of gas to be conducted out of the treatment chamber can be adjusted. Fixed throttle plates or the like can be used instead of the adjustable throttle valves 14 to 19. Also, the upper throttle valves 14 to 16 or the lower throttle valves 17 to 19 can be dispensed with completely or partially according to requirements.

Figure 2:
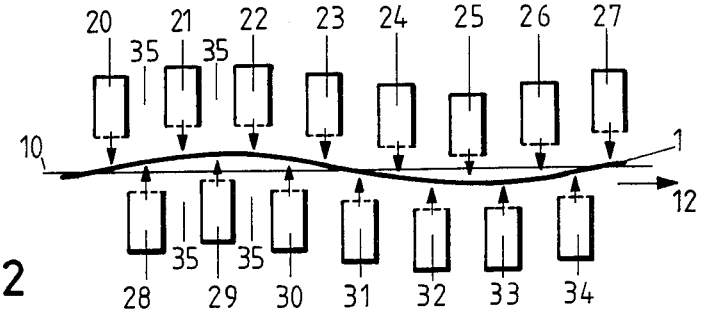
FIG. 2 shows the arrangement of nozzle boxes according to another embodiment of the invention, which is particularly suitable for metal strip of relatively high thickness.

The embodiment of the apparatus according to FIG. 2 is particularly suitable for treating particularly stiff or relatively thick metal strip 1. In this case, the distance between upper nozzle boxes 20 to 27 and lower nozzle boxes 28 to 34, and the center plane 10, is varied over the length of the metal strip 1 at smaller intervals than in the embodiment according to FIG. 1. The sinusoidal line followed by the metal strip 1 while being transported through the apparatus is therefore correspondingly flat.

In this embodiment, too, throttle devices (not shown) may be present in gas discharge channels 35 between the individual nozzle boxes 20 to 34.

Figure 3:
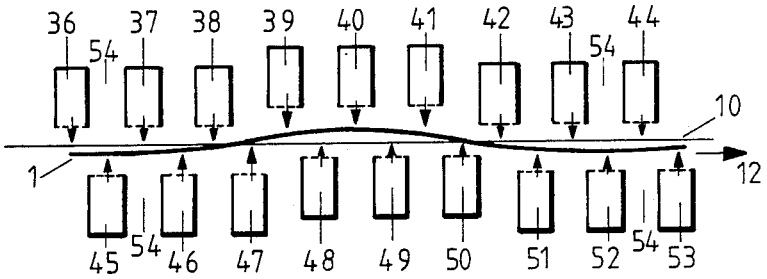
FIG. 3 shows another embodiment of the invention for stiff metal strip.

The embodiment according to FIG. 3 is also particularly suitable for relatively stiff and thick metal strip 1. Of the nozzle boxes 36 to 53, nozzle boxes 36 to 38, 42 to 44, 45 to 47 and 51 to 53 are arranged the same distance away from the center plane 10. Nozzle boxes 39 to 41 and 48 to 50 are arranged a different distance away from the center plane 10. In this embodiment, too, throttle devices may be provided suitably in gas discharge channels 54 between nozzle boxes 36 to 53.

Figure 4:
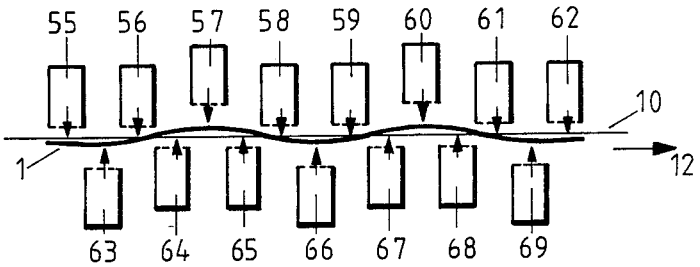
FIG. 4 shows another embodiment of the apparatus according to the invention.

In the embodiment of the apparatus according to FIG. 4, both above and below the metal strip 1, in each case two adjacent nozzle boxes 55, 56; 58, 59; 61, 62; 64, 65 and 67, 68 are arranged the same distance away from the center plane 10. Between each of these pairs of nozzle boxes is located a separate nozzle box 57, 60, 63, 66 and 69 which is a different distance away from the center plane 10.

Figure 5:
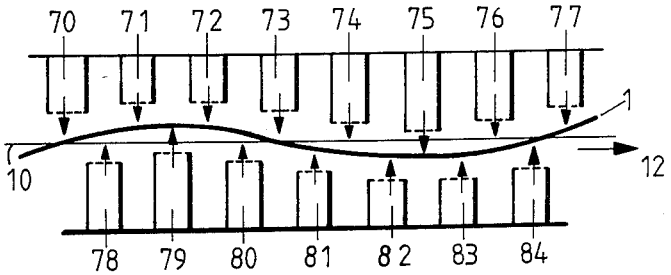
FIG. 5 shows another embodiment of the apparatus according to the invention, in which the surfaces provided with nozzles, but not the nozzle boxes, are offset from a center line.

In the embodiment of the apparatus according to FIG. 5 are provided nozzle boxes 70 to 84 which are not in their entirety offset vertically from the surface of the metal strip 1 or the center plane 1; on the contrary, here only the surfaces of the nozzle boxes 70 to 84 which are provided with nozzles are offset vertically from the surface of the metal strip 1 and hence the center plane 10, in the manner shown.

I claim:

1. Apparatus for contactless, wave form-guiding of a relatively stiff metal strip by means of a gas medium, comprising:

a plurality of nozzle boxes disposed above and below and spaced apart from the metal strip, each of said nozzle boxes having a nozzle outlet plane; and a plurality of gas discharge channels, one said channel being disposed between adjacent pairs of said nozzle boxes;

wherein said nozzle outlet planes are vertically spaced from a substantially horizontal plane corresponding to the direction of transport of the metal strip by distances which vary individually, the positions of said nozzle outlets planes being vertically adjustable to adapt to the wave form; and wherein each wave trough and each wave crest of the wave form faces and is formed by at least two adjacent nozzle boxes on each side of the metal strip which face their respective wave trough or wave crest and discharge gas against one surface of their respective wave trough or wave crest.

2. Apparatus according to claim 1, said nozzle boxes being distributed essentially across the same strip width above and below the metal strip.

3. Apparatus according to claim 1, said nozzle boxes disposed above the metal strip being offset in the direction of transport from said nozzle boxes disposed below the metal strip.

4. Apparatus according to claim 2, said nozzle boxes disposed above the metal strip being offset in the direction of transport from said nozzle boxes disposed below the metal strip.

5. Apparatus according to claim 1, said nozzle boxes disposed above the metal strip being offset at an angle to the direction of transport from said nozzle boxes disposed below the metal strip.

6. Apparatus according to claim 2, said nozzle boxes disposed above the metal strip being offset at an angle to the direction of transport from said nozzle boxes disposed below the metal strip.

* * * * *